US009057260B2

(12) United States Patent
Kelbie et al.

(10) Patent No.: US 9,057,260 B2
(45) Date of Patent: Jun. 16, 2015

(54) THROUGH TUBING EXPANDABLE FRAC SLEEVE WITH REMOVABLE BARRIER

(75) Inventors: Graeme Kelbie, Cypress, TX (US); Richard Yingqing Xu, Tomball, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 981 days.

(21) Appl. No.: 13/171,660

(22) Filed: Jun. 29, 2011

(65) Prior Publication Data

US 2013/0000914 A1 Jan. 3, 2013

(51) Int. Cl.
*E21B 43/26* (2006.01)
*E21B 43/10* (2006.01)

(52) U.S. Cl.
CPC ..... *E21B 43/26* (2013.01); *E21B 43/103* (2013.01)

(58) Field of Classification Search
CPC ..... E21B 43/26; E21B 34/063; E21B 33/124; E21B 43/103; E21B 43/105; E21B 43/108
USPC ..... 166/308.1, 373, 376, 206, 181, 192, 166/193, 207
See application file for complete search history.

(56) References Cited

U.S. PATENT DOCUMENTS

| | | | | |
|---|---|---|---|---|
| 5,425,424 | A | 6/1995 | Reinhardt et al. | |
| 6,026,903 | A | 2/2000 | Shy et al. | |
| 6,145,593 | A | 11/2000 | Hennig | |
| 6,568,470 | B2 | 5/2003 | Goodson, Jr. et al. | |
| 6,926,089 | B2 | 8/2005 | Goodson, Jr. et al. | |
| 6,964,305 | B2 * | 11/2005 | McMahan et al. | 166/380 |
| 7,124,829 | B2 * | 10/2006 | Braddick | 166/382 |
| 7,306,044 | B2 * | 12/2007 | Connell et al. | 166/380 |
| 7,350,582 | B2 * | 4/2008 | McKeachnie et al. | 166/373 |
| 7,373,990 | B2 * | 5/2008 | Harrall et al. | 166/380 |
| 7,533,721 | B2 | 5/2009 | Sorhus | |
| 7,637,323 | B2 * | 12/2009 | Schasteen et al. | 166/318 |
| 7,661,470 | B2 | 2/2010 | Doane et al. | |
| 7,798,236 | B2 * | 9/2010 | McKeachnie et al. | 166/376 |
| 8,020,625 | B2 * | 9/2011 | Ring et al. | 166/380 |
| 8,104,538 | B2 * | 1/2012 | Richard et al. | 166/308.1 |
| 8,191,633 | B2 * | 6/2012 | Frazier | 166/317 |
| 8,267,177 | B1 * | 9/2012 | Vogel et al. | 166/317 |
| 8,403,037 | B2 * | 3/2013 | Agrawal et al. | 166/193 |
| 8,684,096 | B2 * | 4/2014 | Harris et al. | 166/382 |
| 8,826,985 | B2 * | 9/2014 | Xu et al. | 166/308.1 |
| 2004/0244968 | A1 * | 12/2004 | Cook et al. | 166/242.6 |
| 2005/0205264 | A1 * | 9/2005 | Starr et al. | 166/376 |
| 2007/0000664 | A1 * | 1/2007 | Ring et al. | 166/277 |
| 2010/0282469 | A1 * | 11/2010 | Richard et al. | 166/308.1 |
| 2011/0259610 | A1 * | 10/2011 | Shkurti et al. | 166/386 |
| 2011/0284232 | A1 * | 11/2011 | Huang | 166/317 |

* cited by examiner

*Primary Examiner* — Kenneth L Thompson
*Assistant Examiner* — Michael Wills, III
(74) *Attorney, Agent, or Firm* — Steve Rosenblatt

(57) ABSTRACT

Thin wall sleeves are inserted into a well and expanded into sealing position to a surrounding tubular. Each sleeve has a ball seat. A zone is perforated after a sleeve is secured in position below the perforations. The ball is dropped onto the seat and pressure is built up to complete the fracturing. After all zones are perforated and fractured, the balls are removed, preferably by dissolving them and the thin walled sleeves are left in the tubular against which they have been expanded. Production can then begin from a selected zone. The objects can be of the same size for each sleeve. The sleeves can be run through tubing and into casing. Acid can be pumped to dissolve the objects.

20 Claims, 1 Drawing Sheet

THROUGH TUBING EXPANDABLE FRAC SLEEVE WITH REMOVABLE BARRIER

FIELD OF THE INVENTION

The field of the invention is fracturing techniques and more particularly those techniques that replace bridge plugs that have to be milled after the fracturing is completed with rapidly deployed expandable sleeves with barriers removed after all zones are fractured.

BACKGROUND OF THE INVENTION

Fracturing methods commonly involve a technique of starting at the well bottom or isolating a portion of the well that is not to be perforated and fractured with a plug. The first zone is then perforated and fractured and then another plug is placed above the recently perforated zone and the process is repeated in a bottom up direction until all the zones are perforated and fractured. At the end of that process the collection of barriers are milled out. To aid the milling process the plugs can be made of non-metallic or composite materials. While this technique is workable, there was still a lot of time spent to mill out even the softer bridge plugs and remove that milling debris from the wellbore.

In the past there have been plugs used that are milled out as described in U.S. Pat. No. 7,533,721. Some are forcibly broken to open a passage such as in U.S. Pat. No. 6,026,903. Other designs created a plug with material that responded to a magnetic field as the field was applied and removed when the field was removed. This design was described in U.S. Pat. Nos. 6,926,089 and 6,568,470. In a multi-lateral application a plug was dissolved from within the whipstock to reopen the main bore after the lateral was completed. This is described in U.S. Pat. No. 6,145,593. Barriers that assist in extending telescoping passages and then are removed for access to fracture the formation are described in U.S. Pat. No. 5,425,424. Longitudinally extending radially expanded packers to get them to release is shown in U.S. Pat. No. 7,661,470.

What is needed and provided by the present invention is a fracturing system where thin sleeves with external seals, slips or anchors and a ball seat are run in and set in sequence. The next zone is perforated and a ball is landed on a seat and the just perforated zone is fractured. The process repeats until all the zones are fractured at which time the balls are removed from the seats preferably by dissolving them. The thin sleeves remain but are sufficiently thin to avoid materially impeding the subsequent production flow. The sleeves can be run in with coiled tubing or wireline and expanded into sealing contact using known setting tools that can, for example, push a swage through a sleeve to expand the sleeve and the external seal that can be used with the sleeve. Those skilled in the art will better appreciate the various aspects of the invention from a review of the description of the preferred embodiment and the associated FIGS. while appreciating that the full scope of the invention is to be found in the appended claims.

SUMMARY OF THE INVENTION

Thin wall sleeves are inserted into a well and expanded into sealing position to a surrounding tubular. Each sleeve has a ball seat. A zone is perforated after a sleeve is secured in position below the perforations. The ball is dropped onto the seat and pressure is built up to complete the fracturing. After all zones are perforated and fractured, the balls are removed, preferably by dissolving them and the thin walled sleeves are left in the tubular against which they have been expanded. Production can then begin from a selected zone. The objects can be of the same size for each sleeve. The sleeves can be run through tubing and into casing. Acid can be pumped to dissolve the objects.

DETAILED DESCRIPTION OF THE PREFERRED EMBODIMENT

Figure 1:
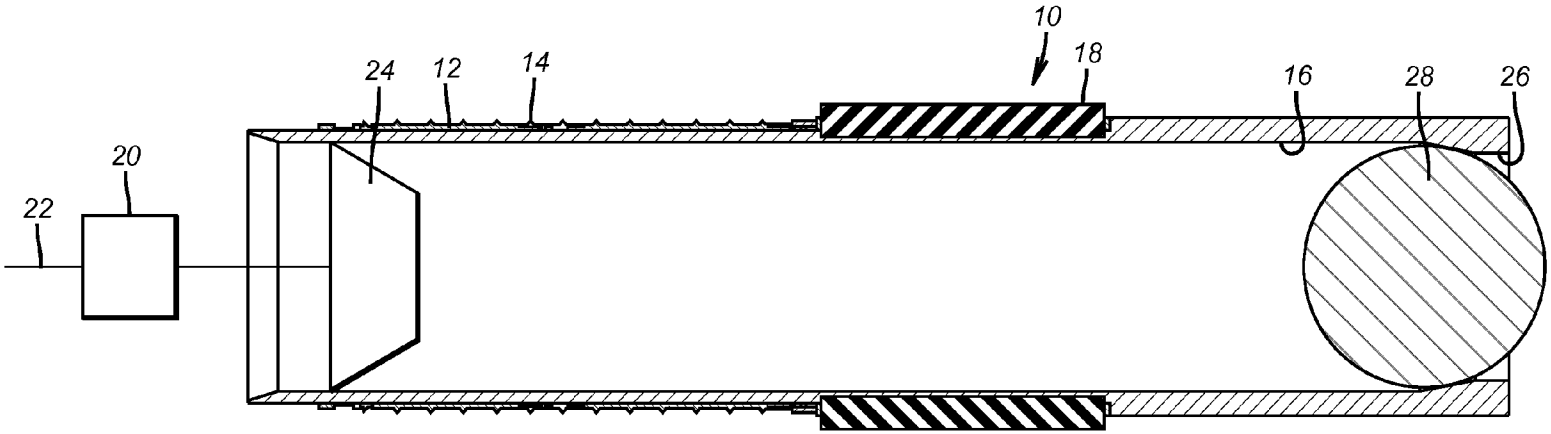
FIG. 1 is a section view of a thin wall sleeve in the set position with a ball landed on the seat.
Figure 2:
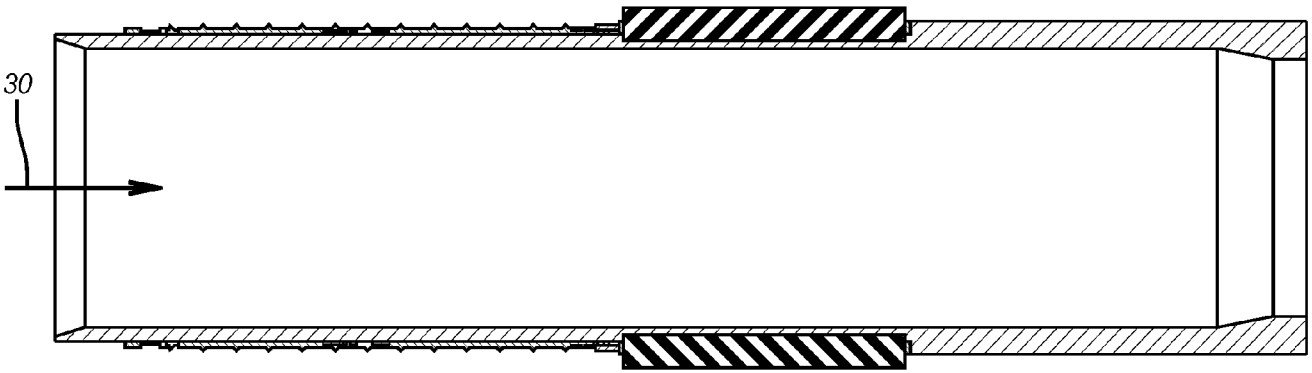
FIG. 2 is the view of FIG. 1 with the ball removed from the seat.

FIG. 1 illustrates a sleeve 10 that is preferably a thin metal tube with slips 12 that have wickers 14 that are intended to penetrate the surrounding tubular (not shown) when the sleeve 10 is expanded radially outwardly from within the passage 16. A seal assembly 18 is also pushed against the surrounding tubular during the expansion. The delivery device can be coiled tubing or wireline schematically illustrated as 22, to name a few examples and the expansion device 20 can be one of a variety of known tools that can advance an internal fixed or variable diameter swage 24. A releaseable connection between the expansion device 20 and the sleeve 10 is envisioned for initial retention of the two to each other for run in. As the expansion of the sleeve starts the initial retainer (not shown) is broken and that initial expansion anchors the sleeve 10 so that the swage 24 can be advanced by the expansion device that can include a combination of a resettable anchor and a stroker that supports the swage 24.

The sleeve has a tapered ring-shaped ball seat 26 that is intended to receive an obstructing object such as a ball 28 to close off passage 16. The ball 28 is dropped after the zone above a particular sleeve 10 has been perforated and the gun dropped or removed from the wellbore. Once the gun is out of the way and the zone perforated, the ball 28 can be dropped to land on seat 26 so that pressure can be elevated from the surface and the newly perforated zone above the sleeve 10 can be fractured. Once that fracturing is completed another sleeve 10 can be run into a higher location or a location closer to the well surface and the process is repeated until all the zones in an interval are fractured. When the bottom up fracturing is completed a chemical is added to the sleeve 10 as shown schematically by arrow 30 that will preferably react with the ball 28 to break it up to the point that the passage 16 at seat 26 is again clear. The ball 28 can be metallic or non-metallic and the added material can be a strong or weak acid or other material that will cause the ball 28 to lose structural integrity or go into solution. Alternatively, the ball 28 in each deployed sleeve can be blown through one or more seats 26 although dissolving the ball or breaking it up so that the debris can be removed from the wellbore is a preferred way to reopen each sleeve.

The inside dimension of passage 16 before expansion can be constant or alternatively the upper segment that has the slips 12 and the seal assembly 18 can have an initially smaller diameter for run in that is expanded to the constant diameter as illustrated in FIG. 1 after the expansion is completed. The expansion stops short of the ball seat 26.

Each sleeve can use the same ball size for ball 28 in the preferred bottom up method. An alternative possibility to remove the balls 28 is to blow them through the ball seat 26. Alternatively the ball seat can be made of a material that dissolves that is either the same as the material of the ball 28 so that when both are removed only the wall thickness of the sleeve that is now somewhat reduced due to its radial expansion is the sole reduction in the drift diameter from adding the sleeves 10. Alternatively each sleeve 10 can have internal grooves above and below the slip 12, which can be in the form of a ring, and the seal 18 that can be grabbed with a tool to longitudinally extent the sleeve to get its diameter to decrease for physical removal from the wellbore with the ball 28 as an alternative to dissolving the ball and leaving the sleeve in place during production.

The advantages over the known way of fracturing by zone from bottom up should now be readily apparent to those skilled in the art. The sleeves stay put and the passage in them is opened with preferably an addition of a solvent to dissolve the balls on each seat and to further remove any undissolved segments to the surface with circulation or reverse circulation. The sleeves can be run through existing production tubing and expanded into case below depending on the size differences between the two nest tubulars. The initial wall thickness of the sleeve 10 needs to be strong enough after expansion to withstand the tensile stress from pressure on the seated ball 28 during fracturing with the sleeve somewhat thinned out during expansion to get the sleeve to be supported by the surrounding casing that has been perforated above the expansion location for each sleeve. The sleeve material has to be amenable to expansion without risk of cracks and should be sufficiently compatible with well fluids to retain structural integrity throughout the perforating and fracturing of all the zones that need to be fractured. As another option the sleeve 10 material can also be made of a dissolvable material so that dissolving the ball has an opportunity to remove the sleeve and the seat and possibly the slip and seal assembly if they break away from the surrounding tubular wall. If this happens the drift diameter reduction from the sleeve and seat remaining behind can be further minimized.

The preferred initial wall thickness for a sleeve is initially 0.25 inches and that wall thickness could be reduced by as under 5% due to expansion depending on the percent expansion. The ability to deliver the sleeves rapidly with a coiled tubing unit, if available, or with a wireline that is more economical and more readily deployable means less time consumed for delivery of the sleeve for each zone to be fractured. The balls 28 can be pumped down or simply dropped depending on the orientation of the wellbore. While the preferred shape of the balls is a sphere, other objects that can seat on seat 26 such as wiper plugs or other elongated objects can also be used.

A big part of the time saving is not having to mill out the bridge plugs that used to be used to separate the zones for fracturing. The preferred dissolving process is much faster and delivers a more certain drift diameter after the fracturing than the milling process that can still leave some plug components in the wellbore.

The above description is illustrative of the preferred embodiment and many modifications may be made by those skilled in the art without departing from the invention whose scope is to be determined from the literal and equivalent scope of the claims below.

We claim:

1. A fracturing method for a plurality of zone comprising:
perforating and fracturing a first zone;
positioning adjacent said first zone at least one sleeve having an upper and a lower end and an open passage therethrough extending from said upper to said lower end during said positioning;
securing said sleeve to a surrounding tubular by expanding said passage;
obstructing said passage with an object after said securing;
fracturing at least a second zone with said passage obstructed.

2. The method of claim 1, comprising:
securing said sleeve by radial expansion of at least a portion of said passage with a removable swage;
removing the object from said sleeve;
producing through said sleeve.

3. The method of claim 2, comprising:
securing said sleeve with a slip assembly to the surrounding tubular by virtue of said passage expanding.

4. The method of claim 3, comprising:
providing a slip ring with exterior wickers to penetrate the surrounding tubular to secure said sleeve.

5. The method of claim 1, comprising:
providing a seat in said sleeve;
expanding said passage short of said seat;
removing the object from said sleeve;
producing through said sleeve.

6. The method of claim 1, comprising:
sealing said sleeve to the surrounding tubular by said passage expanding;
removing the object from said sleeve;
producing through said sleeve.

7. The method of claim 6, comprising:
using a resilient sleeve for said sealing.

8. The method of claim 1, comprising:
positioning said sleeve with coiled tubing or a wireline;
removing the object from said sleeve;
producing through said sleeve.

9. The method of claim 1, comprising:
using a plurality of sleeves to separate multiple zones beyond said first zone;
providing a seat in each sleeve;
sequentially dropping an object on a seat of a secured sleeve when the zone above it is ready to be fractured;
removing the objects from said sleeves;
producing through said sleeves.

10. The method of claim 1, comprising: longitudinally extending said sleeve after fracturing said second zone; removing said sleeve.

11. The method of claim 10, comprising:
removing said object with said sleeve.

12. A fracturing method for a plurality of zone comprising:
perforating and fracturing a first zone;
positioning at least one sleeve having a passage therethrough adjacent said first zone;
securing said sleeve to a surrounding tubular by expanding said passage;
obstructing said passage with an object;
fracturing at least a second zone with said passage obstructed;
providing a seat in said sleeve;
expanding said passage short of said seat;
removing the object from said sleeve;
producing through said sleeve;
landing the object on said seat.

13. The method of claim 12, comprising:
removing said object by dissolving the object;
dissolving at least a part of said sleeve.

14. The method of claim 13, comprising:
removing the object by dissolving said seat with said object.

15. The method of claim 12, comprising:
removing the object by forcing the object through said seat.

16. The method of claim 12, comprising:
landing the object on said seat by dropping or pumping said object.

17. The method of claim 16, comprising:

using a sphere as said object.

18. The method of claim 17, comprising:

using a tapered ring as said seat.

19. A fracturing method for a plurality of zone comprising:

perforating and fracturing a first zone;

positioning at least one sleeve having a passage therethrough adjacent said first zone;

securing said sleeve to a surrounding tubular by expanding said passage;

obstructing said passage with an object;

fracturing at least a second zone with said passage obstructed;

using a plurality of sleeves to separate multiple zones beyond said first zone;

providing a seat in each sleeve;

sequentially dropping an object on a seat of a secured sleeve when the zone above it is ready to be fractured;

removing the objects from said sleeves;

producing through said sleeves;

using the same size object for each seat;

removing all objects together and after all the zones are perforated.

20. The method of claim 19, comprising:

removing said objects that are spherical by dissolving them.

* * * * *